US007018244B2

(12) United States Patent
Muro et al.

(10) Patent No.: US 7,018,244 B2
(45) Date of Patent: Mar. 28, 2006

(54) CONNECTOR

(75) Inventors: Takashi Muro, Haibara-gun (JP); Kaoru Matsumura, Haibara-gun (JP); Nobuyuki Sakamoto, Haibara-gun (JP); Toshiharu Kawashima, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/786,422

(22) Filed: Feb. 26, 2004

(65) Prior Publication Data

US 2004/0171313 A1 Sep. 2, 2004

(30) Foreign Application Priority Data

Feb. 27, 2003 (JP) ..... P. 2003-051057

(51) Int. Cl.
*H01R 13/514* (2006.01)

(52) U.S. Cl. ..... 439/701; 439/355

(58) Field of Classification Search ..... 439/701, 439/352, 355

See application file for complete search history.

(56) References Cited

U.S. PATENT DOCUMENTS 3,399,374 A * 8/1968 Pauza et al. ..... 439/355
4,634,204 A * 1/1987 Detter et al. ..... 439/352
5,571,032 A 11/1996 Sano et al.
5,681,185 A * 10/1997 Briski et al. ..... 439/626
6,116,939 A * 9/2000 Fukuda ..... 439/354

FOREIGN PATENT DOCUMENTS

JP 7-226255 A 8/1995

* cited by examiner

*Primary Examiner*—Briggitte R. Hammond
(74) *Attorney, Agent, or Firm*—Sughrue Mion, PLLC

(57) ABSTRACT

A connector includes an inner housing which holds a plurality of electric wires, an outer housing which accommodates the inner housing along a first direction, a fixing member which fixes the inner housing and the outer housing to each other and a convex portion which protrudes from one of an outer surface of the inner housing and an inner surface of the outer housing in the first direction. When the fixing member fixes the inner housing and the outer housing to each other, the convex portion abuts against the other of the outer surface of the inner housing and the inner surface of the outer housing so that a repulsive force is generated between the inner housing and the outer housing.

6 Claims, 5 Drawing Sheets

CONNECTOR

BACKGROUND OF THE INVENTION

This invention generally relates to a connector, and more particularly to a connector that includes an inner housing holding a large number of electric wires, an outer housing accommodating the inner housing, and a fixing member fixing the inner housing and the outer housing to each other.

Hitherto, there has been known a connector whose housing is split into an outer housing and an inner housing so as to arrange electric wires in an automobile or the like (see, for example, JP-A-7-226255 (page 3, FIG. 2)).

The related connector is configured so that an housing thereof is split into an outer housing and an inner housing. When the outer housing is assembled to the inner housing, first, the inner housing is pushed into and made to enter the outer housing.

A lock hook of the outer housing is inserted into a lock hook insertion hole of the inner housing. A rear wall of the inner housing engages with a latch claw of the lock hook, so that the inner housing is locked in the outer housing.

Meanwhile, a connector is usually provided with a clearance between the inner housing and the outer housing so as to cause the outer housing to accommodate the inner housing.

However, it is considered that the provision of the clearance causes rattle between the outer housing and the inner housing when the connector vibrates.

Especially, because the outer housing and the inner housing are formed of resin material, the outer housing and the inner housing thermally expand under high temperature, so that the clearance increases. Consequently, the rattle between the outer housing and the inner housing increases.

SUMMARY OF THE INVENTION

Accordingly, an object of the invention is to provide a connector enabled to suppress the rattle between an outer housing and an inner housing.

In order to achieve the above object, according to the present invention, there is provided a connector, comprising:

an inner housing, which holds a plurality of electric wires;

an outer housing, which accommodates the inner housing along a first direction;

a fixing member, which fixes the inner housing and the outer housing to each other; and a convex portion, which protrudes from one of an outer surface of the inner housing and an inner surface of the outer housing in the first direction, wherein when the fixing member fixes the inner housing and the outer housing to each other, the convex portion abuts against the other of the outer surface of the inner housing and the inner surface of the outer housing so that a repulsive force is generated between the inner housing and the outer housing.

When the fixing member fixes the inner housing and the outer housing to each other, the top part of the convex portion generates a repulsive force by press-contacting the top part of the convex portion, which protrudes in the accommodating direction in which the inner housing is accommodated, therewith to thereby generate a repulsive force. Consequently, rattle between the inner housing and the outer housing can surely be suppressed.

Preferably, the connector further includes an engaging member which has an engaging projection which protrudes from one of the inner housing and the outer housing in a direction intersecting with the first direction, and which extends along the first direction and an engaging guide groove which is provided in the other of the inner housing and the outer housing, and which engages with and guides the engaging projection along the first direction.

In the above configuration, when the inner housing is accommodated in the outer housing, the engaging projection enters the engaging guide groove. Thus, the engaging member can support the inner housing. Consequently, the rattle between the inner housing and the outer housing can be suppressed.

Preferably, the engaging member is a plurality of the engaging members. Each of the engaging projections of the plurality of the engaging members protrudes in a direction intersecting with the first direction.

In the above configuration, the plurality of the engaging projections are protruded in a direction intersecting with the fixing member. Thus, the inner housing can be more reliably supported. Rattle between the inner housing and the outer housing can be more reliably suppressed.

Preferably, the convex portion is a plurality of the convex portions. Each of the convex portions is disposed in a vicinity of the fixing member.

In the above configuration, each of the convex portions is disposed in the vicinity of the fixing member for maintaining a state in which the inner housing and the outer housing are fixed to each other. Thus, the top part of each of the convex portions is strongly press-contacted therewith.

Also, each of the convex portions generates a strong repulsive force. Consequently, the rattle between the inner housing and the outer housing can be more reliably suppressed.

Incidentally, in a case where the convex portions are placed at positions that are symmetrical with respect to the fixing member, a state, in which the inner housing and the outer housing extend along a same line, is maintained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
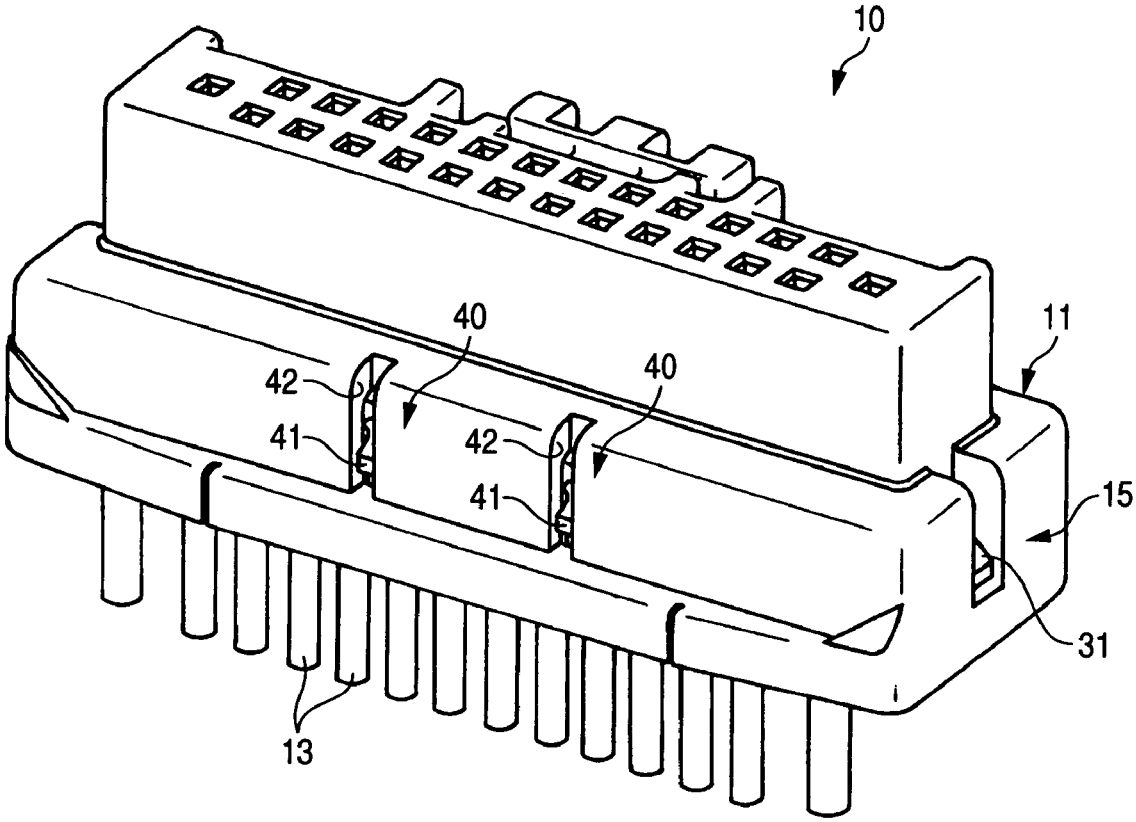
FIG. 1 is a perspective view illustrating a state in which an inner housing of a connector according to the invention is assembled to an outer housing.

Hereinafter, embodiments of the invention are described in detail with reference to the accompanying drawings. Incidentally, the descriptions of members of each of the embodiments, which are the same as those having been described with reference to FIGS. 1 to 3, are simplified or omitted by designating such members with same or corresponding reference characters in the figures.

Figure 2:
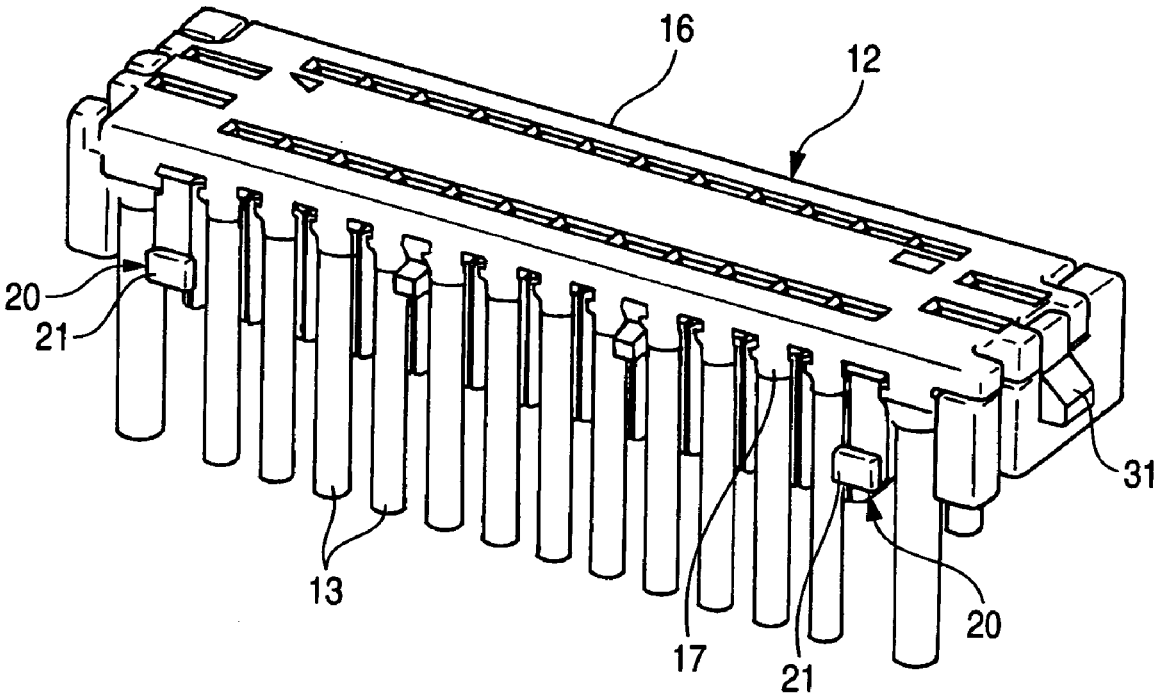
FIG. 2 is a perspective view illustrating the inner housing of the connector according to the invention.
Figure 3:
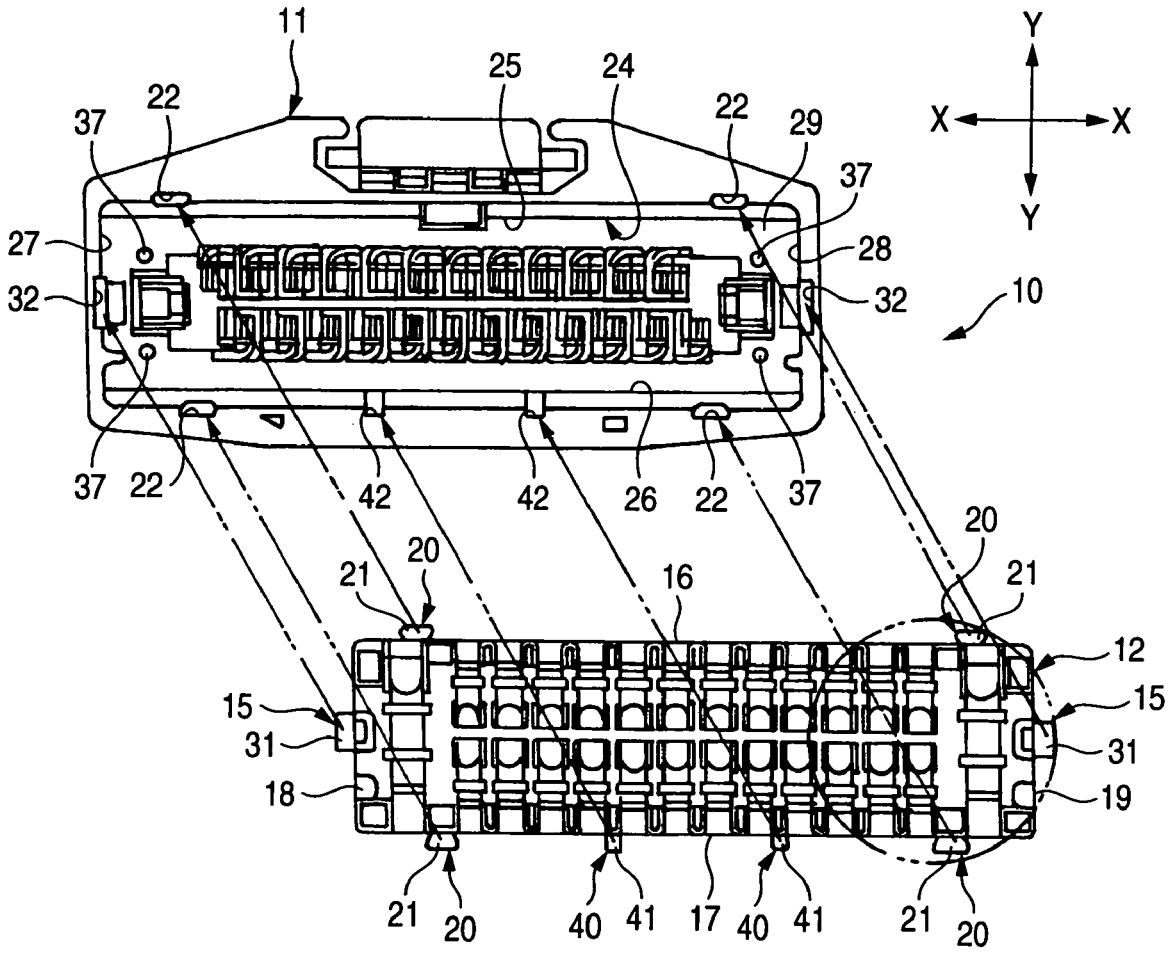
FIG. 3 is a front view illustrating the inner housing and the outer housing of the connector according to the invention.

As shown in FIGS. 1 to 3, a connector 10 is configured so that a housing is split into an outer housing 11 and an inner housing 12 so as to arrange electric wires in an automobile or the like.

This connector 10 includes the inner housing 12 for holding a large number of electric wires 13 arranged in parallel with one another, the outer housing 11 for accommodating the inner housing 12 along a longitudinal direction of each of the electric wires 13, a first fixing member 15 and a second fixing member 40 for fixing the inner housing 12 and the outer housing 11 to each other.

Additionally, the connector 10 includes an engaging member 20 which has engaging projections 21 and engaging guide grooves 22. Each of the engaging projections 21 protrudes from the upper and lower outer (side) surfaces 16 and 17 of the inner housing 12 in a direction intersecting with an accommodating direction in which the inner housing 12 is accommodated, that is, a longitudinal direction of each of the electric wires 13, and continuously extends in the accommodating direction in which the inner housing 12 is accommodated. The engaging guide grooves 22 are provided in the outer housing 11, for engaging and guiding the engaging projections 21 along the accommodating direction.

The inner housing 12 is formed nearly like a rectangle in front view, that is, formed so that each of an upper outer surface 16, a lower outer surface 17, and both outer surfaces 18 and 19 is formed nearly like a rectangle.

The outer housing 11 has an accommodating concave portion 24 for accommodating the inner housing 12. The accommodating concave portion 24 includes an upper inner surface 25, a lower inner surface 26, both inner surfaces 27 and 28, and a bottom surface 29.

Each of the first fixing member 15 includes a latch claw 31 provided on an associated one of both sides 18 and 19 of the inner housing 12, and a latch groove 32 provided in an associated one of both inner surface portions 27 and 28 of the accommodating concave portion 24 provided in the outer housing 11.

The second fixing members 40 include a pair of latch claws 41 formed on a lower outer surface 17 of the inner housing 12 at a predetermined interval, and also include a pair of latch holes 42 formed at a predetermined interval in a lower inner surface portion 26 of the accommodating concave portion 24 provided in the outer housing 11.

Figure 4:
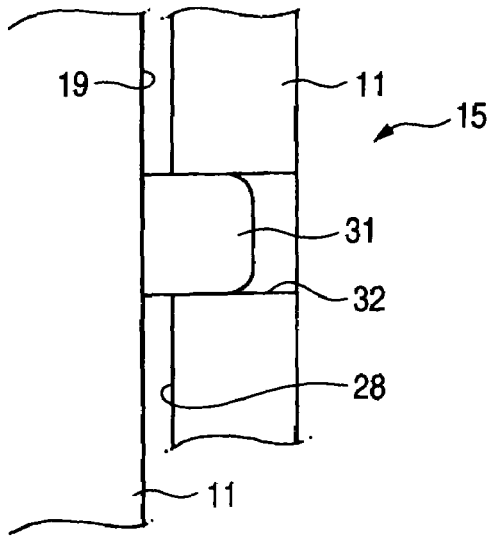
FIG. 4 is a plan view illustrating fixing member of the connector according to the invention.

The first fixing member 15 and the second fixing member 40 are configured so that when the inner housing 12 is pushed into the accommodating concave portion 24 of the outer housing 11 so as to be assembled thereto, each of the latch claws 31 of the inner housing 12 is caught in an associated one of the latch holes 32 of the outer housing 11, as illustrated in FIGS. 1 and 4, and that simultaneously, as shown in FIG. 1, each of the latch claws 41 is caught in an associated one of the latch holes 42 of the outer housing 11.

Thus, the inner housing 12 is locked in the outer housing 11.

Incidentally, the first fixing member 15 and the second fixing member 40 are ordinarily used fixing member. The rattle between the inner housing 12 and the outer housing 11 cannot be sufficiently suppressed only by the fixing members 15 and 40.

Thus, the connector 10 has the engaging member 20, that is the engaging projections 21 and the engaging guide grooves 22. The connector 10 has a plurality of engaging members 20 (for example, 4 engaging members), the each engaging projection 21 is protruded in a direction (a Y-direction shown in FIG. 3) intersecting with the first fixing member 15. Incidentally, the latch claw 31 of each of the first fixing member 15 projects in an X-direction (see FIG. 3).

Concretely, as shown in FIG. 3, paired engaging projections 21 are provided in the vicinity of each of left-side and right-side corner portions of the upper outer surface 16 of the inner housing 12. Also, paired engaging projections 21 are provided in the proximity of each of left-side and right-side corner portions of the lower outer surface 17 of the inner housing 12. These engaging projections 21 are protruded in the Y-direction.

Paired engaging guide grooves 22 are provided in the vicinity of each of the left and right corners of the upper inner surface 25 of the outer housing 11. Also, paired engaging guide grooves 22 are provided in the vicinity of each of the left and right corners of the lower inner surface 26 of the outer housing 11.

The inner housing 12 is surely supported in both the X-direction and the Y-direction by protruding a plurality of engaging members 20 (the engaging projections 21 and the engaging guide grooves 22) in a direction intersecting with the first fixing member 15. The rattle between the inner housing 12 and the outer housing 11 can be suppressed.

Figure 5:
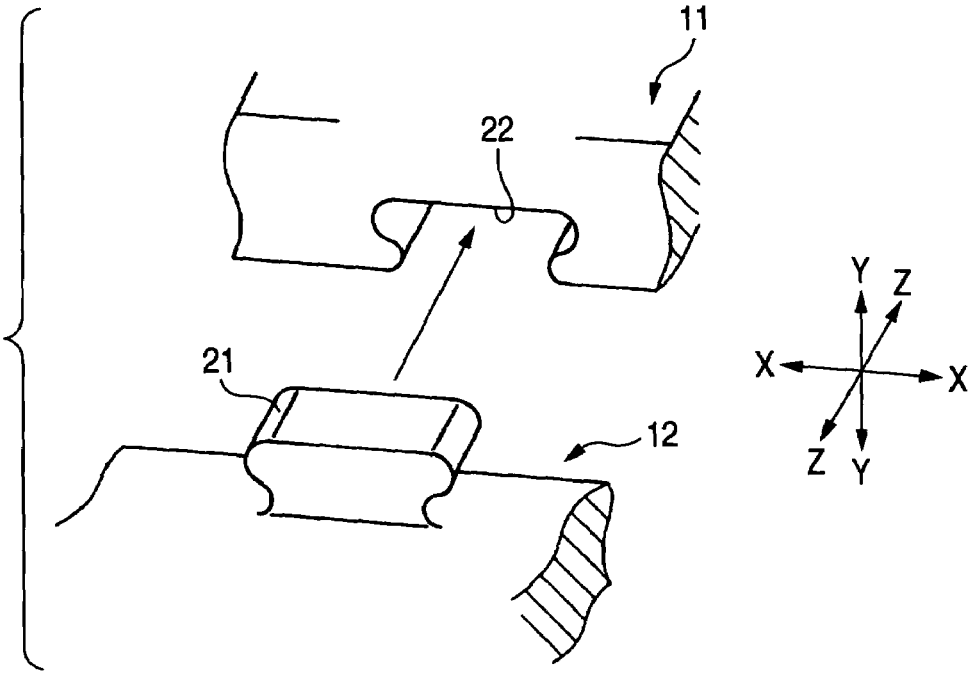
FIG. 5 is a perspective view illustrating an engaging member of the connector according to the invention.
Figure 6:
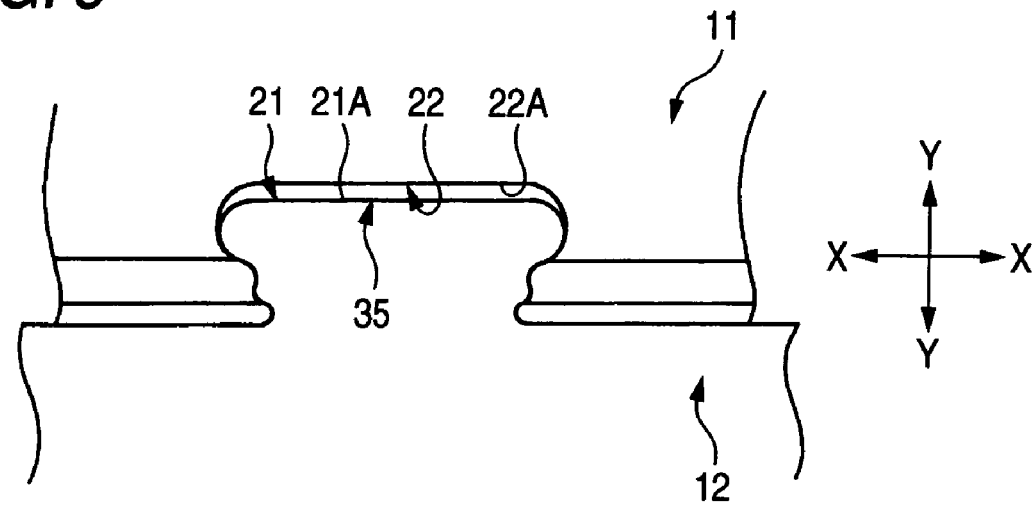
FIG. 6 is a front view illustrating the engaging member of the connector according to the invention.

As shown in FIGS. 5 and 6, each of the engaging projections 21 is formed so that a section thereof is shaped nearly like a trapezoid, which increases in lateral length toward a direction in which the engaging projection 21 protrudes.

Thus, each of the engaging projections 21 is prevented from slipping off an associated one of the engaging guide grooves 22 in a direction perpendicular to the longitudinal direction of each of the electric wires 13 (see FIGS. 1 and 2), that is, in the Y-direction.

Consequently, the engaging member 20 can surely support the inner housing 12 and also can suppress rattle between the inner housing 12 and the outer housing 11.

As shown in FIG. 6, each of the engaging members 20 has a clearance provided between a top portion 21A of an associated one of the engaging projections 21 and a ceiling portion 22A of an associated one of the engaging guide grooves 22.

The provision of the clearance 35 enables smooth insertion of the engaging projection 21 into the engaging guide groove 22 and easy accommodation of the inner housing 12 in the outer housing 11.

Figure 7A:
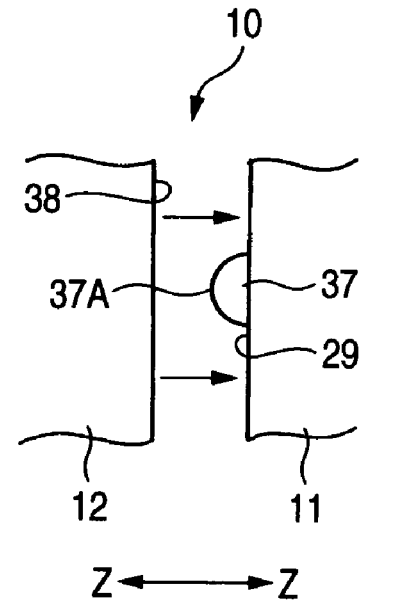
FIGS. 7A and 7B are explanatory views illustrating an operation of a convex portion of the connector according to the invention.
Figure 7B:
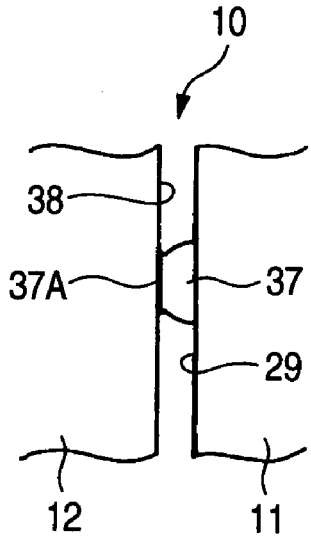

As shown in FIGS. 3, 7A and 7B, the connector 10 has a plurality of convex portions 37 protruding from the inner surface of the outer housing 11, that is, the bottom surface 29 of the accommodating concave portion 24 in an accommodating direction in which the inner housing 12 is accommodated, that is, in a Z-direction.

These convex portions 37 are disposed at positions, which are located in the vicinity of the first fixing member 15 and symmetrical with respect to the first fixing member 15.

The convex portions 37 are formed so that when the first fixing members 15 fix the inner housing 12 and the outer housing 11 to each other, the top portion 37A of each of the convex portions 37 abuts against the outer surface of the inner housing 12, that is, the bottom portion 38 to thereby generate a repulsive force.

When the first fixing members 15 fix the inner housing 12 and the outer housing 11 to each other, the connector housings are held in a state in which the top portion 37A of each of the convex portions 37 generates a repulsive force against the inner housing 12 by press-contacting the bottom portion 38 of the inner housing 12 with the top portions 37A of the convex portions 37.

Further, the rattle in the longitudinal direction of each of the electric wires 13 (see FIGS. 1 and 2), that is, in the Z-direction in the rattles between the inner housing 121 and the outer housing 11 is surely suppressed.

Especially, because the convex portions 37 are respectively disposed in the vicinity of the first fixing member 15, stronger repulsive forces against the inner housing 12 can be obtained. Thus, the rattle between the inner housing 12 and the outer housing 11 can be more surely suppressed.

Moreover, because the convex portions 37 are disposed at places that are symmetrical with the first fixing member 15, the rattle therebetween can be suppressed in a state in which the inner housing 12 and the outer housing 11 extend along a same line.

Incidentally, in the above embodiment, an example, in which each of the engaging projections 21 and an associated one of the engaging claws 31 are intersected with each other by protruding the engaging projections 21 of the engaging member 20 in the Y-direction and also protruding the latch claws 31 of the first fixing member 15 in the X-direction, has been described. The invention is not limited thereto. Similar advantages can be obtained by forming engaging member 20 instead of the first fixing member 15 and causing the engaging projections 21 to intersect with each other.

Further, in the above embodiment, an example, in which the inner housing 12 is provided with the engaging projections 21, and in which the outer housing 11 is provided with the engaging guide grooves 22, has been described. The invention is not limited thereto. Similar advantages can be obtained by providing the engaging projections 21 in the outer housing 11 and by providing the engaging guide grooves 22 in the inner housing 12.

Additionally, the invention is not limited to the aforementioned embodiment. Appropriate modification and improvement can be made. The materials, shapes, dimensions, modes, numbers, locations, thicknesses and so on of the connector 10, the outer housing 11, the inner housing 12, the first fixing member 15, the engaging member 20, the engaging projections 21, the engaging guide grooves 22, and the convex portions 37 exemplified in the foregoing description are optional and not limited to specific ones, as long as the connector lock structure according to the invention can be achieved.

What is claimed is:

1. A connector, comprising:

an inner housing, which holds a plurality of electric wires, said inner housing including a first surface;

an outer housing including a second surface, wherein said inner housing is at least partially inserted into the outer housing along a first direction;

a fixing member, which fixes the inner housing and the outer housing to each other; and a convex portion, which protrudes from one of the first surface of the inner housing toward the second surface in the first direction and the second surface of the outer housing toward the first surface in a direction opposed to the first direction, wherein when the fixing member fixes the inner housing and the outer housing to each other, the convex portion abuts against the other of the first surface of the inner housing and the second surface of the outer housing so that a repulsive force is generated between the inner housing and the outer housing.

2. The connector as set forth in claim 1, wherein the convex portion is a plurality of the convex portions;

wherein each of the convex portions is disposed in a vicinity of the fixing member.

3. The connector as set forth in claim 1, wherein the repulsive force between the inner housing and the outer housing is generated in the first direction.

4. The connector as forth in claim 1, wherein the first surface is parallel to the second surface; and wherein both of the first surface and the second surface are perpendicular to the first direction.

5. The connector as set forth in claim 1, further comprising an engaging member which includes:

an engaging projection, which protrudes from one of the inner housing and the outer housing in a direction intersecting with the first direction, and which extends along the first direction; and an engaging guide groove, which is provided in the other of the inner housing and the outer housing, and which engages with and guides the engaging projection along the first direction.

6. The connector as set forth in claim 5, wherein the engaging member is a plurality of the engaging members; and wherein each of the engaging projections of the plurality of the engaging members protrudes in a direction intersecting with the first direction.

* * * * *